US010373544B1

(12) United States Patent
Fattal

(10) Patent No.: US 10,373,544 B1
(45) Date of Patent: Aug. 6, 2019

(54) TRANSFORMATION FROM TILED TO COMPOSITE IMAGES

(71) Applicant: LEIA INC., Menlo Park, CA (US)

(72) Inventor: David A. Fattal, Mountain View, CA (US)

(73) Assignee: LEIA, INC., Menlo Park, CA (US)

( * ) Notice: Subject to any disclaimer, the term of this patent is extended or adjusted under 35 U.S.C. 154(b) by 0 days.

(21) Appl. No.: 16/031,997

(22) Filed: Jul. 10, 2018

Related U.S. Application Data

(63) Continuation of application No. 15/060,537, filed on Mar. 3, 2016, now abandoned.

(60) Provisional application No. 62/289,170, filed on Jan. 29, 2016.

(51) Int. Cl.
*G09G 3/00* (2006.01)
*G09G 3/20* (2006.01)
*G09G 3/34* (2006.01)

(52) U.S. Cl.
CPC ..... *G09G 3/2003* (2013.01); *G09G 3/003* (2013.01); *G09G 3/2096* (2013.01); *G09G 3/3413* (2013.01); *G09G 2300/0408* (2013.01); *G09G 2310/0291* (2013.01); *G09G 2320/0646* (2013.01); *G09G 2320/0666* (2013.01)

(58) Field of Classification Search
CPC .... G09G 3/2003; G09G 3/003; G09G 3/3413; G09G 3/2096; G09G 2310/0291; G09G 2300/0408; G09G 2320/0666; G09G 2320/0646
See application file for complete search history.

(56) References Cited

U.S. PATENT DOCUMENTS 5,301,062 A 4/1994 Takahashi et al.
5,615,024 A 3/1997 May et al.
5,617,248 A 4/1997 Takahashi et al.
5,926,294 A 7/1999 Sato et al.
(Continued)

FOREIGN PATENT DOCUMENTS

CN 1619373 A 5/2005
CN 101750664 A 6/2010
(Continued)

OTHER PUBLICATIONS

Fattal et al., "A multi-directional backlight for a wide-angle, glasses-free three-dimensional display," Nature, Mar. 21, 2013, pp. 348-351, vol. 495, Macmillan Publishers Limited, 2013.
(Continued)

*Primary Examiner* — Grant Sitta
(74) *Attorney, Agent, or Firm* — J. Michael Johnson

(57) ABSTRACT

A three-dimensional (3D) display driver includes a single buffer and a mapping circuit. The single buffer is configured to store a tiled image that includes a contiguously arranged plurality of tiles. Each tile represents a different 3D view of a 3D image. The different 3D views have associated angular ranges and principal angular directions. The mapping circuit is configured to access the stored tiled image and to map pixels from the different 3D views into pixels at corresponding locations in a composite image. The composite image is configured to spatially interleave the pixels from the different 3D views so that pixels from each of the different 3D views are distributed across the composite image. A 3D electronic display includes the mapping circuit.

19 Claims, 7 Drawing Sheets

(56) References Cited

U.S. PATENT DOCUMENTS 6,652,109 B2 * 11/2003 Nakamura ..... G02B 6/0036 349/63
6,667,819 B2 12/2003 Nishikawa et al.
6,954,223 B2 10/2005 Miyazawa et al.
7,777,691 B1 * 8/2010 Nimmer ..... G06F 3/1446 345/1.2
9,019,240 B2 * 4/2015 Gruhlke ..... G02F 1/13338 345/175
9,128,226 B2 12/2015 Fattal et al.
9,201,270 B2 * 12/2015 Fattal ..... G02F 1/133615
9,298,168 B2 3/2016 Taff et al.
9,389,415 B2 * 7/2016 Fattal ..... G02B 26/0808
9,459,461 B2 10/2016 Santori et al.
9,557,466 B2 * 1/2017 Fattal ..... G02B 6/0068
9,785,119 B2 10/2017 Taff et al.
9,791,701 B2 * 10/2017 Ato ..... G02B 27/017
2002/0008834 A1 1/2002 Suzuki
2003/0086649 A1 5/2003 Zhou
2004/0008155 A1 * 1/2004 Cok ..... G06F 3/1446 345/1.3
2004/0130879 A1 7/2004 Choi et al.
2004/0156182 A1 8/2004 Hatjasalo et al.
2004/0257496 A1 12/2004 Sonoda et al.
2005/0041174 A1 2/2005 Numata
2005/0140832 A1 6/2005 Goldman et al.
2005/0201122 A1 9/2005 Shinohara et al.
2005/0264717 A1 12/2005 Chien et al.
2006/0083476 A1 4/2006 Winkler
2006/0104570 A1 5/2006 Rausch
2007/0058394 A1 3/2007 Yu
2007/0129864 A1 6/2007 Tanaka et al.
2007/0213955 A1 9/2007 Ishida et al.
2007/0298533 A1 12/2007 Yang et al.
2008/0007541 A1 * 1/2008 Eliasson ..... G06F 3/0421 345/176
2008/0225393 A1 9/2008 Rinko
2008/0316303 A1 * 12/2008 Chiu ..... G09G 3/003 348/51
2009/0040426 A1 * 2/2009 Mather ..... H04N 13/312 349/65
2009/0091837 A1 4/2009 Chao et al.
2009/0207342 A1 8/2009 Yamaguchi et al.
2009/0213300 A1 8/2009 Daiku
2009/0244706 A1 10/2009 Levola
2009/0257108 A1 * 10/2009 Gruhlke ..... G02B 6/0076 359/290
2009/0262125 A1 * 10/2009 Swaminathan ..... H04N 13/10 345/581
2009/0322986 A1 12/2009 Wei et al.
2010/0039832 A1 2/2010 Ahlgren et al.
2010/0123952 A1 5/2010 Chen et al.
2010/0134534 A1 * 6/2010 Seesselberg ..... G02B 6/0038 345/690
2010/0207964 A1 8/2010 Kimmel et al.
2010/0284085 A1 * 11/2010 Laakkonen ..... G02B 6/12007 359/575
2010/0302803 A1 12/2010 Bita et al.
2010/0321781 A1 * 12/2010 Levola ..... G02B 27/0081 359/569
2011/0002143 A1 1/2011 Saarikko et al.
2011/0141395 A1 6/2011 Yashiro
2011/0148919 A1 * 6/2011 Heggelund ..... G06T 1/20 345/629
2011/0157257 A1 6/2011 Bennett et al.
2011/0228387 A1 * 9/2011 Shiau ..... G02B 5/045 359/463
2011/0241573 A1 10/2011 Tsai et al.
2011/0310233 A1 * 12/2011 Bathiche ..... H04N 13/32 348/51
2012/0008067 A1 1/2012 Mun et al.
2012/0013962 A1 1/2012 Subbaraman et al.
2012/0113678 A1 5/2012 Cornelissen et al.
2012/0127573 A1 5/2012 Robinson et al.
2012/0249934 A1 10/2012 Li et al.
2013/0082980 A1 4/2013 Gruhlke et al.
2013/0286170 A1 * 10/2013 Qin ..... G02B 27/0093 348/59
2014/0247330 A1 * 9/2014 Baik ..... H04N 5/23219 348/51
2014/0293759 A1 * 10/2014 Taff ..... G02B 27/2292 368/239
2014/0300947 A1 * 10/2014 Fattal ..... G02B 26/0808 359/298
2015/0010265 A1 * 1/2015 Popovich ..... G02F 1/13342 385/10
2015/0086163 A1 * 3/2015 Valera ..... G02B 6/0035 385/37
2015/0355394 A1 * 12/2015 Valera ..... G02B 5/1828 359/571
2016/0132025 A1 * 5/2016 Taff ..... G02B 27/2292 368/239
2016/0238772 A1 * 8/2016 Waldern ..... G02B 5/32
2019/0025494 A1 * 1/2019 Fattal ..... G02B 6/0036

FOREIGN PATENT DOCUMENTS

JP 09-043594 A 2/1997
JP 2000267041 A 9/2000
JP 2002031788 A 1/2002
JP 2004077897 A 3/2004
JP 2004302186 A 10/2004
JP 2009053567 A 3/2009
JP 2009295598 A 12/2009
JP 2010102188 A 5/2010
JP 2011232717 A 11/2011
JP 2012022085 A 2/2012
WO 9909257 A1 2/1999
WO 0162014 A2 8/2001

OTHER PUBLICATIONS

Kee, Edwin., "Hitachi Full Parallax 3D Display Offers Mind Bending Visuals," http://www.ubergizmo.com/2011/10/hitachi-full-parallax-3d-display-offers-mind-bending-visuals, Oct. 4, 2011, 2 pages.

Reichelt et al.,"Holographic 3-D Displays—Electro-holography within the Grasp of Commercialization," Advances in Lasers and Electro-Optics, Optics, Nelson Costa and Adolfo Cartaxo (Ed.), (2010), pp. 683-711, ISBN: 978-953-307-088-9, InTech, Available from: http://www.intechopen.com/books/advances-in-lasers-and-electro-optics/holographic-3-ddisplays-electro-holography-within-the-grasp-of-commercialization.

Son et al., "Three-Dimensional Imaging Methods Based on Multiview Images," IEEE/OSA Journal of Display Technology, Sep. 2005, pp. 125-140, vol. 1, No. 1.

Travis et al., "Collimated light from a waveguide for a display backlight," Optics Express, Oct. 2009, pp. 19714-19719, vol. 17, No. 22.

Xu et al., "Computer-Generated Holography for Dynamic Display of 3D Objects with Full Parallax," International Journal of Virtual Reality, 2009, pp. 33-38, vol. 8, No. 2.

* cited by examiner

TRANSFORMATION FROM TILED TO COMPOSITE IMAGES

CROSS-REFERENCE TO RELATED APPLICATIONS

This application is a continuation patent application of and further claims the benefit of priority to U.S. patent application Ser. No. 15/060,537, filed Mar. 3, 2016, which claims priority to U.S. Provisional Patent Application Ser. No. 62/289,170, filed Jan. 29, 2016, the entire contents of both are incorporated by reference herein.

STATEMENT REGARDING FEDERALLY SPONSORED RESEARCH OR DEVELOPMENT

N/A

BACKGROUND

Electronic displays are a nearly ubiquitous medium for communicating information to users of a wide variety of devices and products. Among the most commonly found electronic displays are the cathode ray tube (CRT), plasma display panels (PDP), liquid crystal displays (LCD), electroluminescent displays (EL), organic light emitting diode (OLED) and active matrix OLEDs (AMOLED) displays, electrophoretic displays (EP) and various displays that employ electromechanical or electrofluidic light modulation (e.g., digital micromirror devices, electrowetting displays, etc.). In general, electronic displays may be categorized as either active displays (i.e., displays that emit light) or passive displays (i.e., displays that modulate light provided by another source). Among the most obvious examples of active displays are CRTs, PDPs and OLEDs/AMOLEDs. Displays that are typically classified as passive when considering emitted light are LCDs and EP displays. Passive displays, while often exhibiting attractive performance characteristics including, but not limited to, inherently low power consumption, may find somewhat limited use in many practical applications given the lack of an ability to emit light.

To overcome the applicability limitations of passive displays associated with light emission, many passive displays are coupled to an external light source. The coupled light source may allow these otherwise passive displays to emit light and function substantially as an active display. Examples of such coupled light sources are backlights. Backlights are light sources (often so-called 'panel' light sources) that are placed behind an otherwise passive display to illuminate the passive display. For example, a backlight may be coupled to an LCD or an EP display. The backlight emits light that passes through the LCD or the EP display. The light emitted by the backlight is modulated by the LCD or the EP display and the modulated light is then emitted, in turn, from the LCD or the EP display. Often backlights are configured to emit white light. Color filters are then used to transform the white light into various colors used in the display. The color filters may be placed at an output of the LCD or the EP display (less common) or between the backlight and the LCD or the EP display, for example. Alternatively, the various colors may be implemented by field-sequential illumination of a display using different colors, such as primary colors.

BRIEF DESCRIPTION OF THE DRAWINGS

Various features of examples and embodiments in accordance with the principles described herein may be more readily understood with reference to the following detailed description taken in conjunction with the accompanying drawings, where like reference numerals designate like structural elements, and in which.

Figure 1:
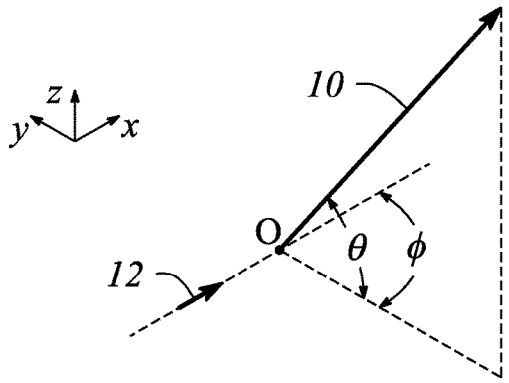
FIG. 1 illustrates a graphical view of angular components $\{\theta, \phi\}$ of a light beam having a particular principal angular direction, according to an example of the principles describe herein.

Certain examples and embodiments have other features that are one of in addition to and in lieu of the features illustrated in the above-referenced figures. These and other features are detailed below with reference to the above-referenced figures.

DETAILED DESCRIPTION

Embodiments and examples in accordance with the principles described herein provide a composite image suitable for driving pixels in a three-dimensional (3D) electronic display. In particular, a tiled image with different 3D views of a 3D image (which have associated angular ranges and principal angular directions) is transformed into the composite image so that pixels in the different 3D views are mapped into pixels at corresponding locations in the composite image. The resulting composite image spatially interleaves the pixels from the different 3D views so that pixels from each of the different 3D views are distributed across the composite image. In some embodiments, sequential pixels in each of the 3D views in the tiled image are mapped to pixels in different regions in the composite image. In order to facilitate the mapping, a display driver may include a buffer that stores the tiled image. In particular, the buffer may store an entire tiled image with the 3D views, such as a full frame of 3D video.

Moreover, in some embodiments the 3D electronic display is used to display 3D information, e.g., an autostereoscopic or 'glasses free' 3D electronic display.

In particular, a 3D electronic display may employ a grating-based backlight having an array of multibeam diffraction gratings. The multibeam diffraction gratings may be used to couple light from a light guide and to provide coupled-out light beams corresponding to pixels of the 3D electronic display. The coupled-out light beams may have different principal angular directions (also referred to as 'differently directed light beams') from one another. According to some embodiments, these differently directed light beams produced by the multibeam diffraction gratings may be modulated and serve as 3D pixels corresponding to 3D views of the 'glasses free' 3D electronic display to display 3D information.

In these embodiments, because the modulated light beams output from each of the multibeam diffraction gratings have different principal angular directions (which are associated with different 3D views), it is easier to drive the pixels in the 3D electronic display using the pixels in the composite image. In particular, because the composite image spatially interleave the pixels from the different 3D views so that pixels from each of the different 3D views are distributed across the composite image, when driving pixels in the 3D electronic display using the pixels in the composite image, the pixels for a particular 3D view are distributed over the coupled-out light beams from multiple diffraction gratings having a particular principal angular direction. However, the 3D views are typically generated for a 3D image (e.g., by projecting or rotating the 3D image along the principal angular directions) as separate 3D views that are included in a tiled image. Consequently, in the image-processing technique, the tiled image is mapped or transformed into the composite image prior to displaying the composite image on the 3D electronic display, i.e., prior to driving pixels in the 3D electronic display based on the composite image.

In some embodiments, this mapping or transformation is performed by a mapping circuit. For example, the tiled image may be stored in a buffer in a driver (which is sometimes referred to as a 'display driver'), and the mapping circuit in the driver may access the tiled image and transform it into the composite image prior to displaying the 3D views of the 3D image on the 3D electronic display. However, more generally, the mapping or transformation may be, at least in part, performed by another component, such as a graphics processing unit that generates the tiled image based on the 3D image.

Herein a 'light guide' is defined as a structure that guides light within the structure using total internal reflection. In particular, the light guide may include a core that is substantially transparent at an operational wavelength of the light guide. The term 'light guide' generally refers to a dielectric optical waveguide that employs total internal reflection to guide light at an interface between a dielectric material of the light guide and a material or medium that surrounds that light guide. By definition, a condition for total internal reflection is that a refractive index of the light guide is greater than a refractive index of a surrounding medium adjacent to a surface of the light guide material. In some embodiments, the light guide may include a coating in addition to or instead of the aforementioned refractive index difference to further facilitate the total internal reflection. The coating may be a reflective coating, for example. The light guide may be any of several light guides including, but not limited to, one or both of a plate or slab guide and a strip guide.

Further herein, the term 'plate' when applied to a light guide as in a 'plate light guide' is defined as a piece-wise or differentially planar layer or sheet, which is sometimes referred to as a 'slab' guide. In particular, a plate light guide is defined as a light guide configured to guide light in two substantially orthogonal directions bounded by a top surface and a bottom surface (i.e., opposite surfaces) of the light guide. Further, by definition herein, the top and bottom surfaces are both separated from one another and may be substantially parallel to one another in at least a differential sense. That is, within any differentially small region of the plate light guide, the top and bottom surfaces are substantially parallel or co-planar.

In some embodiments, a plate light guide may be substantially flat (i.e., confined to a plane) and so the plate light guide is a planar light guide. In other embodiments, the plate light guide may be curved in one or two orthogonal dimensions. For example, the plate light guide may be curved in a single dimension to form a cylindrical shaped plate light guide. However, any curvature has a radius of curvature sufficiently large to insure that total internal reflection is maintained within the plate light guide to guide light.

According to various embodiments described herein, a diffraction grating (e.g., a multibeam diffraction grating) may be employed to scatter or couple light out of a light guide (e.g., a plate light guide) as a light beam. Herein, a 'diffraction grating' is generally defined as a plurality of features (i.e., diffractive features) arranged to provide diffraction of light incident on the diffraction grating. In some examples, the plurality of features may be arranged in a periodic or quasi-periodic manner. For example, the plurality of features (e.g., a plurality of grooves in a material surface) of the diffraction grating may be arranged in a one-dimensional (1-D) array. In other examples, the diffraction grating may be a two-dimensional (2-D) array of features. The diffraction grating may be a 2-D array of bumps on or holes in a material surface, for example.

As such, and by definition herein, the 'diffraction grating' is a structure that provides diffraction of light incident on the diffraction grating. If the light is incident on the diffraction grating from a light guide, the provided diffraction or diffractive scattering may result in, and thus be referred to as, 'diffractive coupling' in that the diffraction grating may couple light out of the light guide by diffraction. The diffraction grating also redirects or changes an angle of the light by diffraction (i.e., at a diffractive angle). In particular, as a result of diffraction, light leaving the diffraction grating (i.e., diffracted light) generally has a different propagation direction than a propagation direction of the light incident on the diffraction grating (i.e., incident light). The change in the propagation direction of the light by diffraction is referred to as 'diffractive redirection' herein. Hence, the diffraction grating may be understood to be a structure including diffractive features that diffractively redirects light incident on the diffraction grating and, if the light is incident from a light guide, the diffraction grating may also diffractively couple out the light from light guide.

Further, by definition herein, the features of a diffraction grating are referred to as 'diffractive features' and may be one or more of at, in and on a surface (i.e., wherein a 'surface' refers to a boundary between two materials). The surface may be a surface of a plate light guide. The diffractive features may include any of a variety of structures that diffract light including, but not limited to, one or more of grooves, ridges, holes and bumps, and these structures may be one or more of at, in and on the surface. For example, the diffraction grating may include a plurality of parallel grooves in a material surface. In another example, the diffraction grating may include a plurality of parallel ridges rising out of the material surface. The diffractive features (whether grooves, ridges, holes, bumps, etc.) may have any of a variety of cross sectional shapes or profiles that provide diffraction including, but not limited to, one or more of a sinusoidal profile, a rectangular profile (e.g., a binary diffraction grating), a triangular profile and a saw tooth profile (e.g., a blazed grating).

By definition herein, a 'multibeam diffraction grating' is a diffraction grating that produces coupled-out light that includes a plurality of light beams. Further, the light beams of the plurality produced by a multibeam diffraction grating have different principal angular directions from one another, by definition herein. In particular, by definition, a light beam of the plurality has a predetermined principal angular direction that is different from another light beam of the light beam plurality as a result of diffractive coupling and diffractive redirection of incident light by the multibeam diffraction grating. The light beam plurality may represent a light field. For example, the light beam plurality may include eight light beams that have eight different principal angular directions. The eight light beams in combination (i.e., the light beam plurality) may represent the light field, for example. According to various embodiments, the different principal angular directions of the various light beams are determined by a combination of a grating pitch or spacing and an orientation or rotation of the diffractive features of the multibeam diffraction grating at points of origin of the respective light beams relative to a propagation direction of the light incident on the multibeam diffraction grating.

In particular, a light beam produced by the multibeam diffraction grating has a principal angular direction given by angular components $\{\theta, \phi\}$, by definition herein. The angular component $\theta$ is referred to herein as the 'elevation component' or 'elevation angle' of the light beam. The angular component $\phi$ is referred to as the 'azimuth component' or 'azimuth angle' of the light beam. By definition, the elevation angle $\theta$ is an angle in a vertical plane (e.g., perpendicular to a plane of the multibeam diffraction grating) while the azimuth angle $\phi$ is an angle in a horizontal plane (e.g., parallel to the multibeam diffraction grating plane). FIG. 1 illustrates the angular components $\{\theta, \phi\}$ of a light beam 10 having a particular principal angular direction, according to an example of the principles describe herein. In addition, the light beam 10 is emitted or emanates from a particular point, by definition herein. That is, by definition, the light beam 10 has a central ray associated with a particular point of origin within the multibeam diffraction grating. FIG. 1 also illustrates the light beam point of origin O. An example propagation direction of incident light is illustrated in FIG. 1 using a bold arrow 12 directed toward the point of origin O.

According to various embodiments, characteristics of the multibeam diffraction grating and features (i.e., diffractive features) thereof, may be used to control one or both of the angular directionality of the light beams and a wavelength or color selectivity of the multibeam diffraction grating with respect to one or more of the light beams. The characteristics that may be used to control the angular directionality and wavelength selectivity include, but are not limited to, one or more of a grating length, a grating pitch (feature spacing), a shape of the features, a size of the features (e.g., groove width or ridge width), and an orientation of the grating. In some examples, the various characteristics used for control may be characteristics that are local to a vicinity of the point of origin of a light beam.

Further according to various embodiments described herein, the light coupled out of the light guide by the diffraction grating (e.g., a multibeam diffraction grating) represents a pixel of an electronic display. In particular, the light guide having a multibeam diffraction grating to produce the light beams of the plurality having different principal angular directions may be part of a backlight of or used in conjunction with an electronic display such as, but not limited to, a 'glasses free' three-dimensional (3D) electronic display (also referred to as a multiview or 'holographic' electronic display or an autostereoscopic display). As such, the differently directed light beams produced by coupling out guided light from the light guide using the multibeam diffractive grating may be or represent '3D pixels' of the 3D electronic display. Further, the 3D pixels correspond to different 3D views or 3D view angles of the 3D electronic display.

Moreover, a 'collimator' is defined as structure that transforms light entering the collimator and into collimated light at an output of the collimator that has a degree of collimation. In particular the collimator may reflect, refract or reflect and refract input light into a collimated output beam along a particular direction. In some embodiments, the collimator may be configured to provide collimated light having a predetermined, non-zero propagation angle in a vertical plane corresponding to the vertical direction or equivalently with respect to a horizontal plane. According to some embodiments, the light source may include different optical sources (such as different LEDs) that provide different colors of light, and the collimator may be configured to provide collimated light at different, color-specific, non-zero propagation angles corresponding to each of the different colors of the light.

Herein, a 'light source' is defined as a source of light (e.g., an apparatus or device that emits light). For example, the light source may be a light emitting diode (LED) that emits light when activated. The light source may be substantially any source of light or optical emitter including, but not limited to, one or more of a light emitting diode (LED), a laser, an organic light emitting diode (OLED), a polymer light emitting diode, a plasma-based optical emitter, a fluorescent lamp, an incandescent lamp, and virtually any other source of light. The light produced by a light source may have a color or may include a particular wavelength of light. As such, a 'plurality of light sources of different colors' is explicitly defined herein as a set or group of light sources in which at least one of the light sources produces light having a color, or equivalently a wavelength, that differs from a color or wavelength of light produced by at least one other light source of the light source plurality. Moreover, the 'plurality of light sources of different colors' may include more than one light source of the same or substantially similar color as long as at least two light sources of the plurality of light sources are different color light sources (i.e., produce a color of light that is different between the at least two light sources). Hence, by definition herein, a plurality of light sources of different colors may include a first light source that produces a first color of light and a second light source that produces a second color of light, where the second color differs from the first color.

Moreover, a 'pixel' in a 3D view or 3D image may be defined as a minute area in a 3D view or a 3D image. Thus, the 3D image may include multiple pixels. Alternatively, a 'pixel' in a 3D electronic display may be defined as a minute area of illumination in the 3D electronic display, such as a cell in a liquid crystal display.

Further, as used herein, the article 'a' is intended to have its ordinary meaning in the patent arts, namely 'one or more'. For example, 'a grating' means one or more gratings and as such, 'the grating' means 'the grating(s)' herein. Also, any reference herein to 'top', 'bottom', 'upper', 'lower', 'up', 'down', 'front', back', 'first', 'second', 'left' or 'right' is not intended to be a limitation herein. Herein, the term 'about' when applied to a value generally means within the tolerance range of the equipment used to produce the value, or may mean plus or minus 10%, or plus or minus 5%, or plus or minus 1%, unless otherwise expressly specified. Further, the term 'substantially' as used herein means a majority, or almost all, or all, or an amount within a range of about 51% to about 100%. Moreover, examples herein are intended to be illustrative only and are presented for discussion purposes and not by way of limitation.

The coupled-out light beams provided by multibeam diffraction gratings (and, thus, the modulated light beams) have different principal angular directions and different associated angular ranges, such as a radial distance in angular space over which the intensity of the 3D views are reduced by two thirds. These coupled-out light beams correspond to different 3D views of a 3D image, where a particular 3D view is associated with a particular angular direction. This 3D view is provided by a subset of the coupled-out light beams from multiple multibeam diffraction gratings. Thus, in order to modulate the subset of the coupled-out light beams to produce this 3D view, a subset of the pixels in light valves in a 3D electronic display associated with the multiple multibeam diffraction gratings usually needs to be driven based on the pixels in this particular 3D view. Moreover, because subsets of the pixels for different 3D views are distributed across or over the 3D electronic display, it is typically easier to drive the pixels based on a composite image in which the pixels from the different 3D views are spatially interleaved so that pixels from each of the different 3D views are distributed across the composite image. However, the 31) views are typically generated based on the 3D image separately from each other, i.e., the pixels in each of the 3D views are separated from each other in a tiled image. Consequently, an image-processing technique may be used to map or transform the tiled image into the composite image, so that the 3D views in the composite image can be display on the 3D electronic display.

Figure 2A:
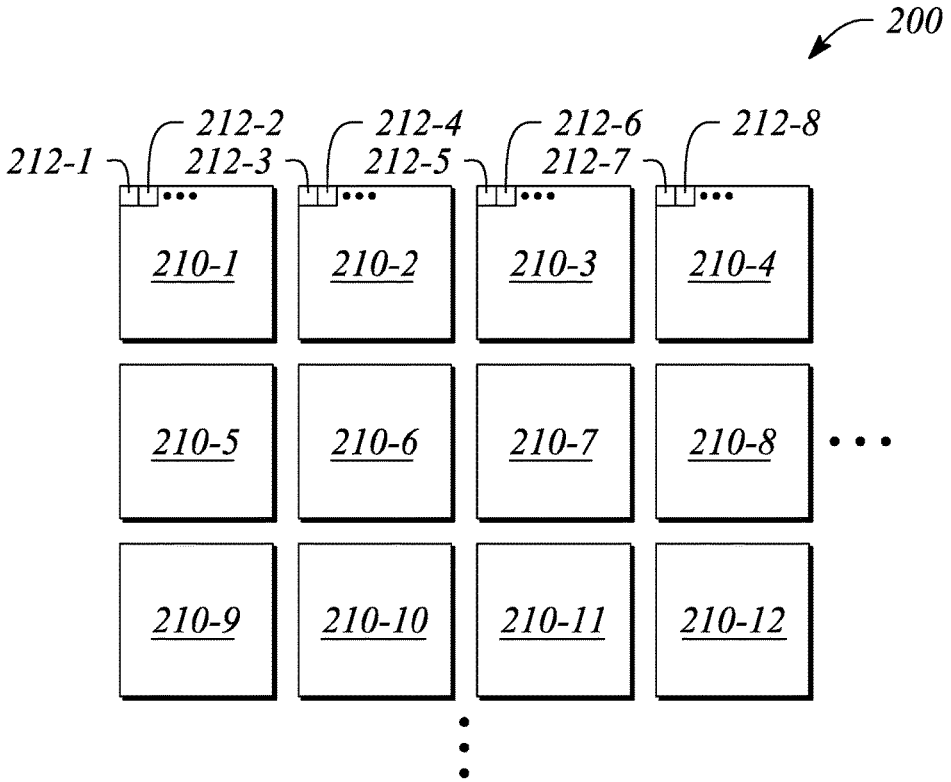
FIG. 2A illustrates a drawing of a tiled image with 3D views of a 3D image in an example, according to an embodiment of the principles described herein.

FIG. 2A illustrates a drawing of a tiled image 200 with 3D views 210 of a 3D image in an example, according to an embodiment of the principles described herein. In particular, pixels in each of the 3D views 210 are separate from each other in the tiled image 200. Note that each of the 3D views 210 is associated one of the principal angular directions. In some embodiments, the 3D views 210 include sixty-four (64) 3D views. However, there may be a different number of 3D views in other embodiments. FIG. 2A also illustrates an example of sequential pixels 212 in each of the 3D views 210 (such as pixels 212-1, 212-2, etc.) in a convenient, but non-limiting configuration.

Figure 2B:
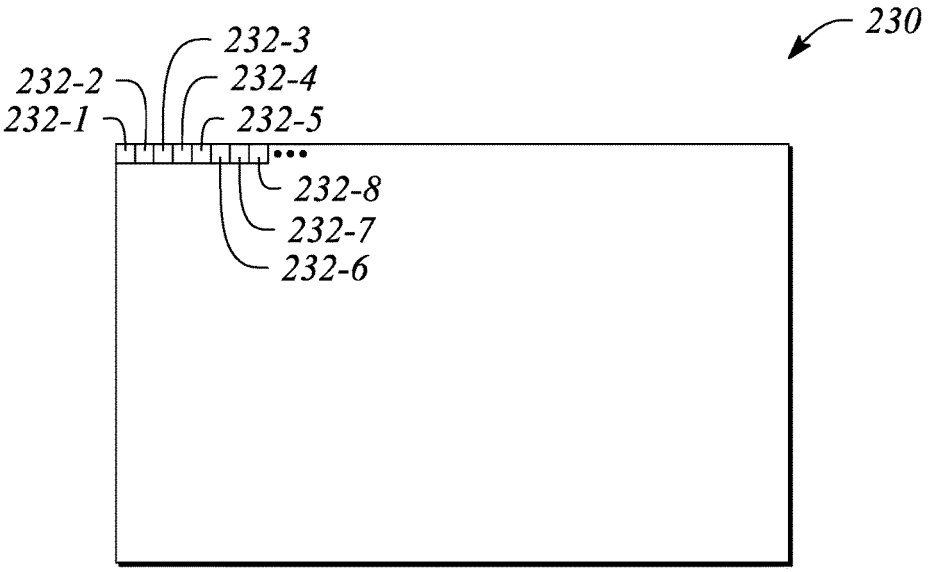
FIG. 2B illustrates a drawing of permutating pixels in 3D views in a tiled image into pixels in a composite image in an example, according to an embodiment of the principles described herein.

FIG. 2B illustrates a drawing of permutating pixels 212 in the 3D views 210 in the tiled image 200 into pixels 232 in a composite image 230 in an example, according to an embodiment of the principles described herein. During the permutation, the pixels 212 are mapped into the pixels 232 at corresponding locations in the composite image 230. The resulting composite image 230 spatially interleaves the pixels 212 from the different 3D views 210 so that the pixels 232 from each of the different 3D views 210 are distributed across the composite image 230. In general, one or more different spatial configurations of the pixels 232 in the composite image 230 may be used in different embodiments. For example, in FIG. 2B the sequential pixels 212 of FIG. 2A are mapped to the pixels 232 in different regions in the composite image 230. In particular, pixels in a particular 3D image in the tiled image 200 may be mapped to pixels in the composite image 230 that are associated with the coupled-out light beams from the different multibeam diffraction gratings that have the same principal angular direction. In some embodiments, pixels 212-1, 212-3, 212-5, etc. in the left uppermost corner of the first row in the 3D views 210 are arranged sequentially (from left to right) as pixels 232-1, 232-2, 232-3, etc. in the first row in the composite image 230, then pixels 212-2, 212-4, 212-6, etc. (i.e., adjacent to pixels 212-1, 212-3, 212-5, etc.) in the first row in the 3D views 210 are arranged sequentially as pixels 232-4, 232-5, 232-6, etc. (i.e., immediately after pixels 232-1, 232-2, 232-3, etc.) in the composite image 230, etc. Note that when the first row in the composite image 230 is full, the remaining pixels in a particular group of pixels from the 3D views 210 (or the next group of pixels) continues in the next row in the composite image 230 (filling from left to right). While such an orderly mapping or transformation may be easier to implement (and may simplify the 3D electronic display), other mappings (and, thus, other spatial arrangements or configurations) of the pixels 232 may be used. However, whatever spatial arrangement or configuration is used, the mapping or transformation from the pixels 212 to the pixels 232 is unique for a 3D electronic display.

Figure 2C:
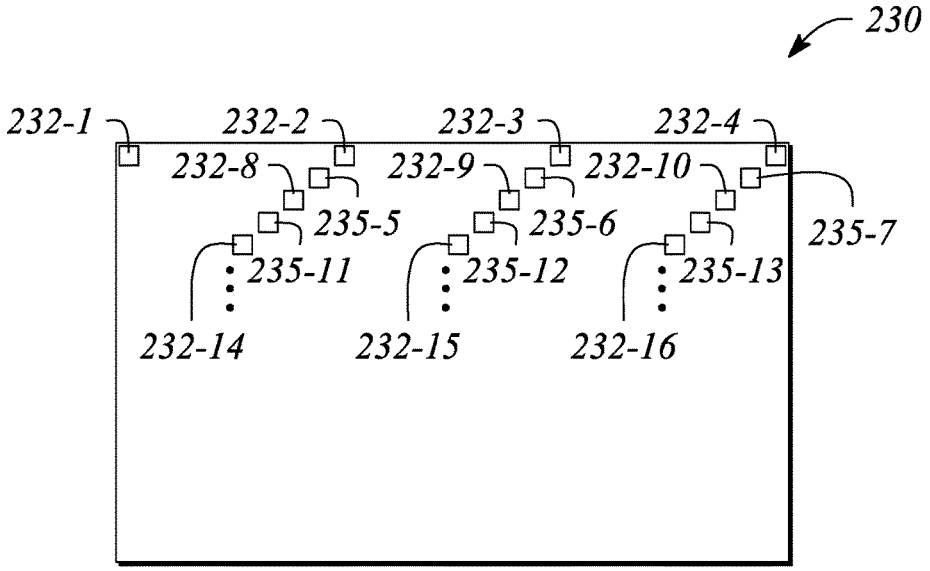
FIG. 2C illustrates a drawing of a composite image with spatially interleaved pixels in 3D views in an example, according to an embodiment of the principles described herein.

FIG. 2C illustrates a drawing of the composite image 230 with spatially interleaved pixels 232 in the 3D views 210 in an example, according to an embodiment of the principles described herein. In particular, FIG. 2C illustrates the locations of the pixels 232 associated with the 3D view 210-1. These pixels may be separated by the pixels associated with the other 3D views 210, e.g., there may be sixty three (63) intervening pixels between the pixels 232 shown in FIG. 2C.

In some embodiments of the image-processing technique, the pixels 212 in the 3D views 210 are specified using a tensor notation $I_{ijkl}$, where i and j specify the row and column in the tiled image 200 of a particular 3D view (such i and j both equal to zero for the 3D view 210-1), and k and l specify the row and column of a pixel in the particular 3D view. After the mapping in the image-processing technique, the pixels 232 associated with the 3D views 210 in the composite image 230 may be specified by $I_{klij}$, i.e., the mapping may be performed by transposing the view and the pixel indices in the tensor notation.

While the image-processing technique may be used with different embodiments of a 3D electronic device, in the discussion that follows a 3D electronic device that includes multibeam diffraction gratings is used as an illustrative example.

Figure 3:
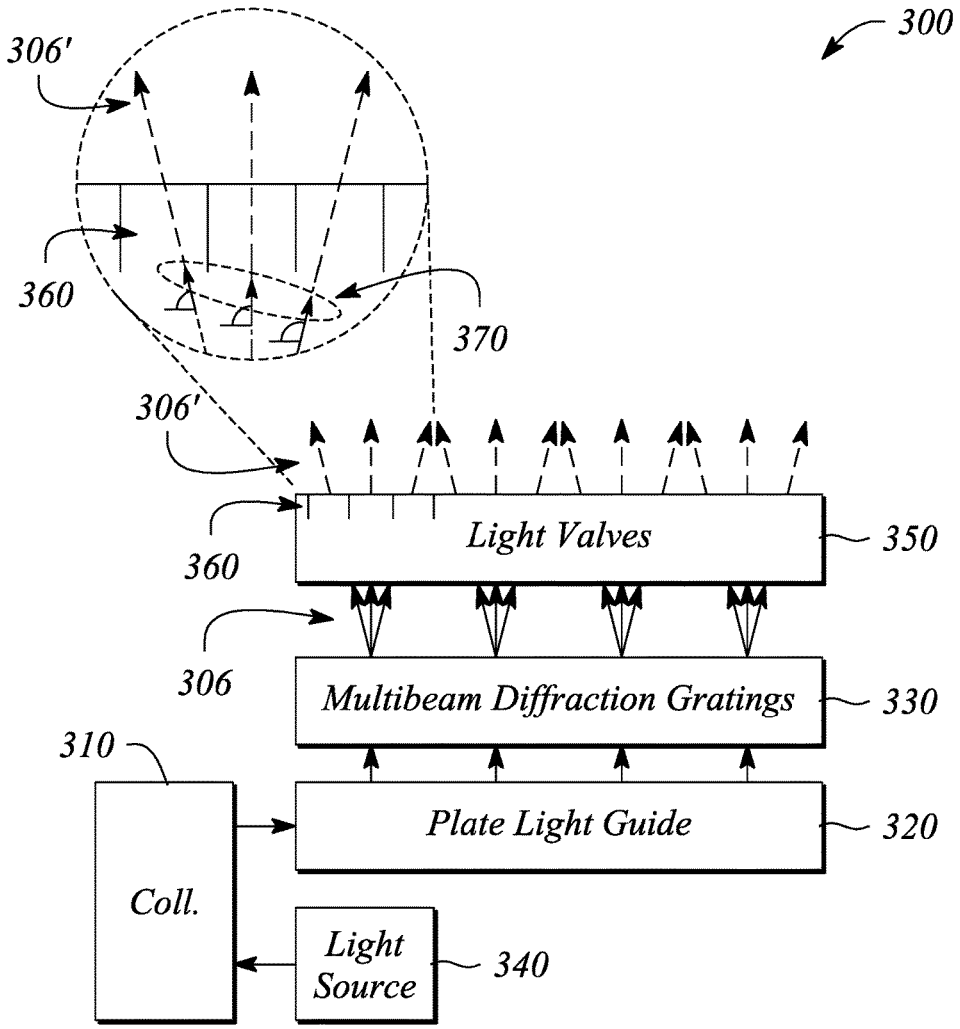
FIG. 3 illustrates a block diagram of a three-dimensional (3D) electronic display in an example, according to an embodiment of the principles described herein.

In accordance with some embodiments of the principles described herein, a 3D electronic display is provided. FIG. 3 illustrates a block diagram of a 3D electronic display 300 in an example, according to an embodiment of the principles described herein. The 3D electronic display 300 is configured to produce directional light comprising light beams having different principal angular directions and, in some embodiments, also having a plurality of different colors. For example, the 3D electronic display 300 may provide or generate a plurality of different light beams 306 directed out and away from the 3D electronic display 300 in different predetermined principal angular directions (e.g., as a light field). Further, the different light beams 306 may include light beams 306 of or having different colors of light. In turn, the light beams 306 of the plurality may be modulated as modulated light beams 306' to facilitate the display of information including color information (e.g., when the light beams 306 are color light beams), according to some embodiments.

In particular, the modulated light beams 306' having different predetermined principal angular directions 370 may form a plurality of pixels 360 of the 3D electronic display 300. In some embodiments, the 3D electronic display 300 may be a so-called 'glasses free' 3D color electronic display (e.g., a multiview, 'holographic' or autostereoscopic display) in which the light beams 306' correspond to the pixels 360 associated with different 'views' of the 3D electronic display 300. The modulated light beams 306' are illustrated using dashed line arrows 306' in FIG. 3, while the different light beams 306 prior to modulation are illustrated as solid line arrows 306, by way of example.

As illustrated in FIG. 3, the 3D electronic display 300 further comprises a plate light guide 320. The plate light guide 320 is configured to guide collimated light as a guided light beam at a non-zero propagation angle. In particular, the guided light beam may be guided at the non-zero propagation angle relative to a surface (e.g., one or both of a top surface and a bottom surface) of the plate light guide 320. The surface may be parallel to the horizontal plane in some embodiments.

According to various embodiments and as illustrated in FIG. 3, the 3D electronic display 300 further comprises an array of multibeam diffraction gratings 330 located at a surface of the plate light guide 320. In particular, a multibeam diffraction grating of the array is configured to diffractively couple out a portion of the guided light beam as plurality of coupled-out light beams having different principal angular directions and representing the light beams 306 in FIG. 3. Moreover, the different principal angular directions of the light beams 306 coupled out by the multibeam diffraction gratings 330 correspond to different 3D views of the 3D electronic display 300, according to various embodiments. In some embodiments, the multibeam diffraction grating of the array comprises a chirped diffraction grating having curved diffractive features. In some embodiments, a chirp of the chirped diffraction grating is a linear chirp.

In some embodiments, the 3D electronic display 300 (e.g., as illustrated in FIG. 3) further comprises a light source 340 configured to provide light to an input of the plate light guide 320. In particular, the light source 340 may comprise a plurality of different light emitting diodes (LEDs) configured to provide different colors of light (referred to as 'different colored LEDs' for simplicity of discussion). In some embodiments, the different colored LEDs may be offset (e.g., laterally offset) from one another. The offset of the different colored LEDs is configured to provide different, color-specific, non-zero propagation angles of the collimated light from a collimator (Coll.) 310. Further, a different, color-specific, non-zero propagation angle may correspond to each of the different colors of light provided by the light source 340.

In some embodiments (not illustrated), the different colors of light may comprise the colors red, green and blue of a red-green-blue (RGB) color model. Further, the plate light guide 320 may be configured to guide the different colors as light beams at different color-dependent non-zero propagation angles within the plate light guide 320. For example, a first guided color light beam (e.g., a red light beam) may be guided at a first color-dependent, non-zero propagation angle, a second guided color light beam (e.g., a green light beam) may be guided at a second color-dependent non-zero propagation angle, and a third guided color light beam (e.g., a blue light beam) may be guided at a third color-dependent non-zero propagation angle, according to some embodiments. Note that a 'color light beam' may include a wavelength of light corresponding to a particular color (such as red, blue or green).

As illustrated in FIG. 3, the 3D electronic display 300 may further comprise a light valve array 350. According to various embodiments, the light valve array 350 is configured to modulate the coupled-out light beams 306 of the light beam plurality as the modulated light beams 306' to form or serve as the 3D pixels corresponding to the different 3D views of the 3D electronic display 300. In some embodiments, the light valve array 350 comprises a plurality of liquid crystal light valves. In other embodiments, the light valve array 350 may comprise another light valve including, but not limited to, an electrowetting light valve, an electrophoretic light valve, a combination thereof, or a combination of liquid crystal light valves and another light valve type, for example. Note that these light valves are sometimes referred to as 'cells' or 'pixels' (such as pixels 360) in the 3D electronic display 300.

In FIG. 3, light beams 306 diffractively coupled out of a multibeam diffraction grating of the array have different principal angular directions 370. These light beams 306 are modulated by the pixels 360 in the light valves 350 to produce the modulated light beams 306'. Using the 3D electronic display 300 with a twisted nematic liquid crystal as an example, the modulated light beams 306' may be produced by applying pixel drive signals to the light valves 350. These pixel drive signals may be six (6) or eight (8) bit digital values that result in discrete or stepwise analog signals (e.g., from a driver circuit, which may be included in a 'driver' or a 'display driver') applied to the cells or the pixels 360 in the light values 350, for example. It should be understood however, more generally, the pixel drive signals may be an analog signal or a digital signal. The discrete analog signals may include voltages that oriented the molecules in the twisted nematic liquid crystal so that the birefringence of the twisted nematic liquid crystal produces a desired rotation or phase change of the light beams 306 as they the transit the pixels 360. The varying phase change may result in different intensities of light being passed by crossed polarizers in the pixels 360 (and, thus, different intensities of the modulated light beams 306'). In this way, a desired brightness and contrast can be produced across the 3D electronic display 300. Moreover, a location in color space can be obtained by applying different voltages to subsets of the pixels 360 associated with different colors (in embodiments where color filters are used) or by applying different voltages to the pixels 360 at different times (in embodiments where the color of the light beams 306 varies sequentially as a function of time between different colors, i.e., the light beams are color light beams in a field-sequential-color system). In particular, the human visual system may integrate the different intensities of different colors for the different pixels 360 to perceive a location in color space.

Furthermore, the pixels 360 may be driven using pixel drive signals that include the information corresponding to the pixels in the composite image. For example, a given one of the pixels 360 may be driven using a pixel drive signal corresponding to a pixel in the composite image.

Figure 4A:
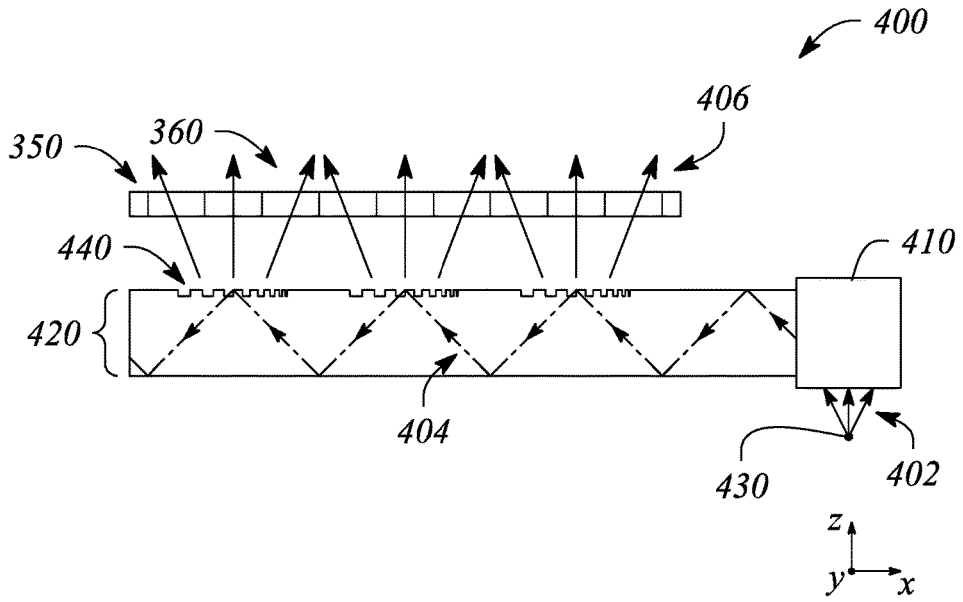
FIG. 4A illustrates a cross sectional view of an alignment between an output aperture of a dual surface collimator and an input aperture of a plate light guide in an example, according to an embodiment consistent with the principles described herein.
Figure 4B:
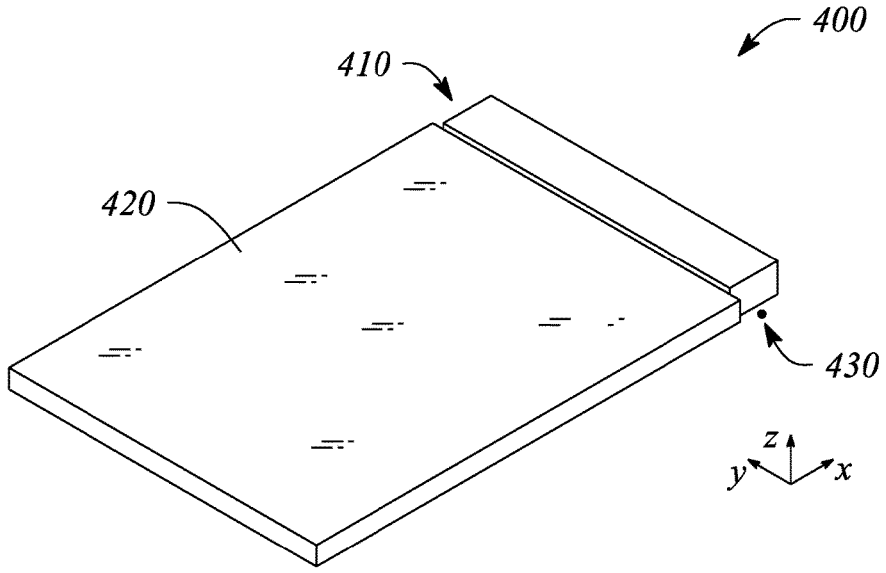
FIG. 4B illustrates a perspective view of an alignment between an output aperture of a dual surface collimator and an input aperture of a plate light guide in an example, according to an embodiment consistent with the principles described herein.

FIG. 4A illustrates a cross sectional view of a multibeam diffraction grating-based display 400 in an example, according to an embodiment consistent with the principles of the principles described herein. FIG. 4B illustrates a perspective view of the multibeam diffraction grating-based display 400 in an example, according to an embodiment consistent with the principles described herein. As illustrated in FIG. 4A, a plate light guide 420 is configured to receive and to guide the collimated light 404 at a non-zero propagation angle. In particular, the plate light guide 420 may receive the collimated light 404 at an input end or equivalently an input aperture of the plate light guide 420. According to various embodiments, the plate light guide 420 is further configured to emit a portion of the guided, collimated light 404 from a surface of the plate light guide 420. In FIG. 4A, emitted light 406 is illustrated as a plurality of rays (arrows) extending away from the plate light guide surface. Also illustrated in FIG. 4A is the light valve array 350 with pixels 360.

In some embodiment, the plate light guide 420 may be a slab or plate optical waveguide comprising an extended, planar sheet of substantially optically transparent, dielectric material. The planar sheet of dielectric material is configured to guide the collimated light 404 from the collimator 410 as a guided light beam 404 using total internal reflection. The dielectric material may have a first refractive index that is greater than a second refractive index of a medium surrounding the dielectric optical waveguide. The difference in refractive indices is configured to facilitate total internal reflection of the guided light beam 404 according to one or more guided modes of the plate light guide 420.

According to various examples, the substantially optically transparent material of the plate light guide 420 may include or be made up of any of a variety of dielectric materials including, but not limited to, one or more of various types of glass (e.g., silica glass, alkali-aluminosilicate glass, borosilicate glass, etc.) and substantially optically transparent plastics or polymers (e.g., poly(methyl methacrylate) or 'acrylic glass', polycarbonate, etc.). In some examples, the plate light guide 420 may further include a cladding layer (not illustrated) on at least a portion of a surface (e.g., one or both of the top surface and the bottom surface) of the plate light guide 420. The cladding layer may be used to further facilitate total internal reflection, according to some examples.

According to some embodiments, the multibeam diffraction grating-based display 400 may further comprise the light source 430. The light source 430 is configured to provide light 402 to the collimator 410. In particular, the light source 430 is configured to provide the light 402 as collimated light 404 (or a collimated light beam). In various embodiments, the light source 430 may comprise substantially any source of light including, but not limited to, one or more light emitting diodes (LEDs). In some embodiments, the light source 430 may comprise an optical emitter configured produce a substantially monochromatic light having a narrowband spectrum denoted by a particular color. In particular, the color of the monochromatic light may be a primary color of a particular color space or color model (e.g., a red-green-blue (RGB) color model). In some embodiments, the light source 430 may comprise a plurality of different optical sources configured to provide different colors of light. The different optical sources may be offset from one another, for example. The offset of the different optical sources may be configured to provide different, color-specific, non-zero propagation angles of the collimated light 404 corresponding to each of the different colors of light, according to some embodiments. In particular, the offset may add an additional non-zero propagation angle component to the non-zero propagation angle provided by the collimator 410, for example.

According to some embodiments (e.g., as illustrated in FIG. 4A), the multibeam diffraction grating-based display 400 may further comprise a multibeam diffraction grating 440 at a surface of the plate light guide 420. The multibeam diffraction grating 440 is configured to diffractively couple out a portion of the guided, collimated light 404 from the plate light guide 420 as a plurality of light beams 406. The plurality of light beams 406 (i.e., the plurality of rays (arrows) illustrated in FIG. 4A) represents the emitted light 406. In various embodiments, a light beam 406 of the light beam plurality has a principal angular direction that is different from principal angular directions of other light beams 406 of the light beam plurality.

In some embodiments, the multibeam diffraction grating 440 is a member of or is arranged in an array of multibeam diffraction gratings 440. In some embodiments, the multibeam diffraction grating-based display 400 is a 3D electronic display and the principal angular direction of the light beam 406 corresponds to a view direction of the 3D electronic display.

Figure 5A:
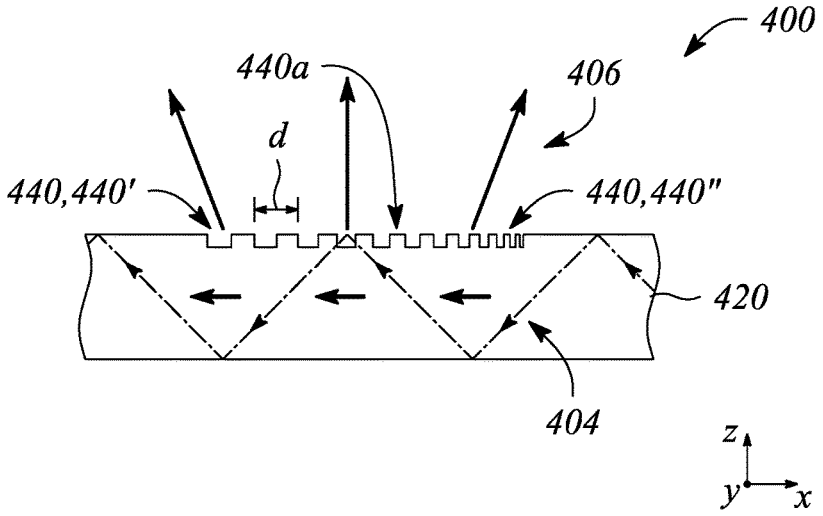
FIG. 5A illustrates a cross sectional view of a portion of a backlight with a multibeam diffraction grating in an example, according to an embodiment consistent with the principles described herein.
Figure 5B:
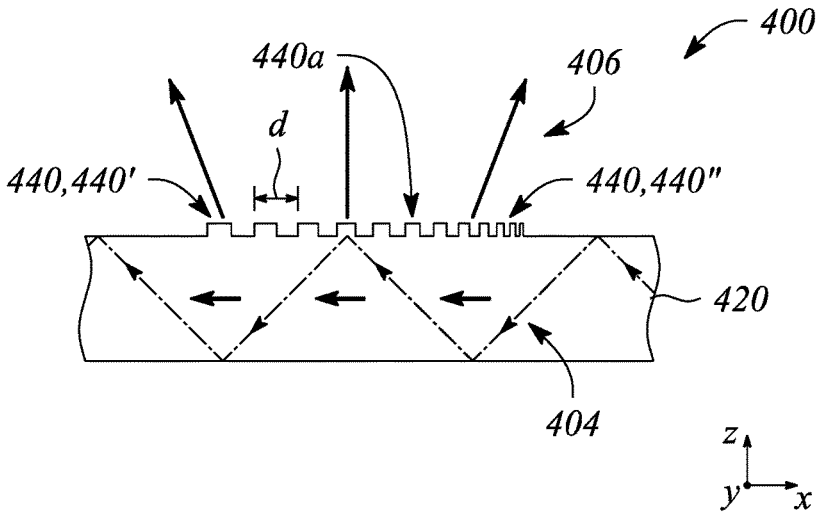
FIG. 5B illustrates a cross sectional view of a portion of a backlight with a multibeam diffraction grating in an example, according to another embodiment consistent with the principles described herein.
Figure 5C:
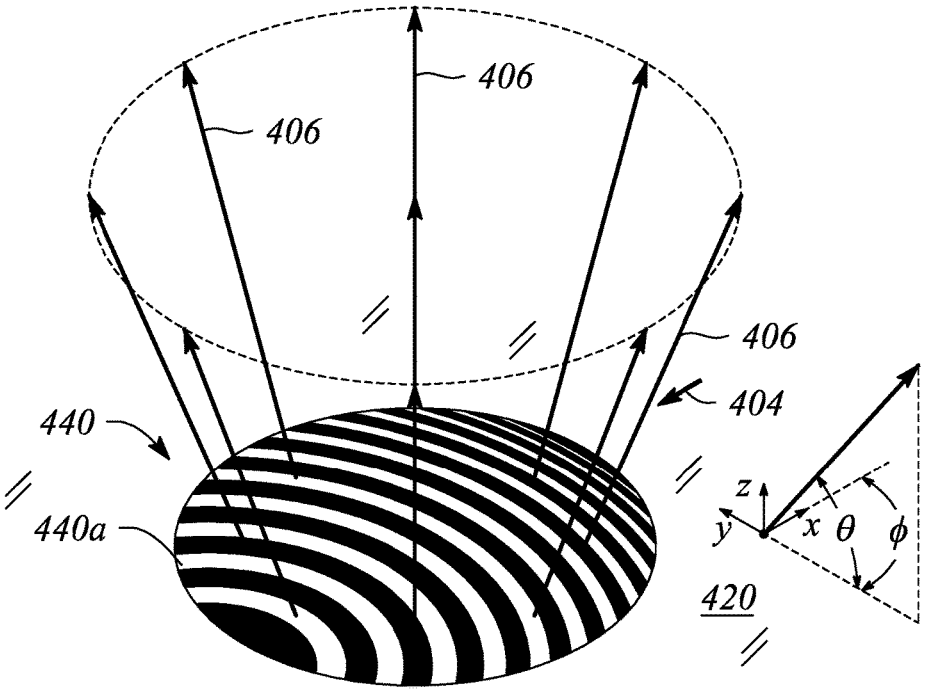
FIG. 5C illustrates a perspective view of the backlight portion of either FIG. 5A or FIG. 5B including the multibeam diffraction grating in an example, according to an embodiment consistent with the principles described herein.

FIG. 5A illustrates a cross sectional view of a portion of a multibeam diffraction grating-based display 400 with a multibeam diffraction grating 440 in an example, according to an embodiment consistent with the principles described herein. FIG. 5B illustrates a cross sectional view of a portion of a multibeam diffraction grating-based display 400 with a multibeam diffraction grating 440 in an example, according to another embodiment consistent with the principles described herein. FIG. 5C illustrates a perspective view of a portion of either FIG. 5A or FIG. 5B including the multibeam diffraction grating 440 in an example, according to an embodiment consistent with the principles described herein. The multibeam diffraction grating 440 illustrated in FIG. 5A comprises grooves in a surface of the plate light guide 420, by way of example and not limitation. FIG. 5B illustrates the multibeam diffraction grating 440 comprising ridges protruding from the plate light guide surface.

As illustrated in FIGS. 5A and 5B, the multibeam diffraction grating 440 is a chirped diffraction grating. In particular, the diffractive features 440*a* are closer together at a second end 440" of the multibeam diffraction grating 440 than at a first end 440'. Further, the diffractive spacing d of the illustrated diffractive features 440*a* varies from the first end 440' to the second end 440". In some embodiments, the chirped diffraction grating of the multibeam diffraction grating 440 may have or exhibit a chirp of the diffractive spacing d that varies linearly with distance. As such, the chirped diffraction grating of the multibeam diffraction grating 440 may be referred to as a 'linearly chirped' diffraction grating.

In another embodiment, the chirped diffraction grating of the multibeam diffraction grating 440 may exhibit a non-linear chirp of the diffractive spacing d. Various non-linear chirps that may be used to realize the chirped diffraction grating include, but are not limited to, an exponential chirp, a logarithmic chirp or a chirp that varies in another, substantially non-uniform or random but still monotonic manner. Non-monotonic chirps such as, but not limited to, a sinusoidal chirp or a triangle or sawtooth chirp, may also be employed. Combinations of any of these types of chirps may also be used in the multibeam diffraction grating 440.

As illustrated in FIG. 5C, the multibeam diffraction grating 440 includes diffractive features 440*a* (e.g., grooves or ridges) in, at or on a surface of the plate light guide 420 that are both chirped and curved (i.e., the multibeam diffraction grating 440 is a curved, chirped diffraction grating, as illustrated). The guided light beam 404 guided in the plate light guide 420 has an incident direction relative to the multibeam diffraction grating 440 and the plate light guide 420, as illustrated by a bold arrow in FIGS. 5A-5C. Also illustrated is the plurality of coupled-out or emitted light beams 406 pointing away from the multibeam diffraction grating 440 at the surface of the plate light guide 420. The illustrated light beams 406 are emitted in a plurality of different predetermined principal angular directions. In particular, the different predetermined principal angular directions of the emitted light beams 406 are different in both azimuth and elevation (e.g., to form a light field).

According to various examples, both the predefined chirp of the diffractive features 440*a* and the curve of the diffractive features 440*a* may be responsible for a respective plurality of different predetermined principal angular directions of the emitted light beams 406. For example, due to the diffractive feature curve, the diffractive features 440*a* within the multibeam diffraction grating 440 may have varying orientations relative to an incident direction of the guided light beam 404 within the plate light guide 420. In particular, an orientation of the diffractive features 440*a* at a first point or location within the multibeam diffraction grating 440 may differ from an orientation of the diffractive features 440*a* at another point or location relative to the guided light beam incident direction. With respect to the coupled-out or emitted light beam 406, an azimuthal component $\phi$ of the principal angular direction $\{\theta, \phi\}$ of the light beam 406 may be determined by or correspond to the azimuthal orientation angle $\phi_f$ of the diffractive features 440*a* at a point of origin of the light beam 406 (i.e., at a point where the incident guided light beam 404 is coupled out). As such, the varying orientations of the diffractive features 440*a* within the multibeam diffraction grating 440 produce the different light beams 406 having different principal angular directions $\{\theta, \phi\}$, at least in terms of their respective azimuthal components $\phi$.

In particular, at different points along the curve of the diffractive features 440*a*, an 'underlying diffraction grating' of the multibeam diffraction grating 440 associated with the curved diffractive features 440*a* has different azimuthal orientation angles $\phi_f$. By 'underlying diffraction grating', it is meant that diffraction gratings of a plurality of non-curved diffraction gratings in superposition yield the curved diffractive features 440*a* of the multibeam diffraction grating 440. Thus, at a given point along the curved diffractive features 440*a*, the curve has a particular azimuthal orientation angle $\phi_f$ that generally differs from the azimuthal orientation angle $\phi_f$ at another point along the curved diffractive features 440*a*. Further, the particular azimuthal orientation angle $\phi_f$ results in a corresponding azimuthal component $\phi$ of a principal angular direction $\{\theta, \phi\}$ of a light beam 406 emitted from the given point. In some examples, the curve of the diffractive features 440*a* (e.g., grooves, ridges, etc.) may represent a section of a circle. The circle may be coplanar with the light guide surface. In other examples, the curve may represent a section of an ellipse or another curved shape, e.g., that is coplanar with the plate light guide surface.

In other embodiments, the multibeam diffraction grating 440 may include diffractive features 440*a* that are 'piecewise' curved. In particular, while the diffractive feature 440*a* may not describe a substantially smooth or continuous curve per se, at different points along the diffractive feature 440*a* within the multibeam diffraction grating 440, the diffractive feature 440*a* still may be oriented at different angles with respect to the incident direction of the guided light beam 404. For example, the diffractive feature 440*a* may be a groove including a plurality of substantially straight segments, each segment having a different orientation than an adjacent segment. Together, the different angles of the segments may approximate a curve (e.g., a segment of a circle), according to various embodiments. In yet other examples, the diffractive features 440*a* may merely have different orientations relative to the incident direction of the guided light at different locations within the multibeam diffraction grating 440 without approximating a particular curve (e.g., a circle or an ellipse).

In some embodiments, the grooves or ridges that form the diffractive features 440*a* may be etched, milled or molded into the plate light guide surface. As such, a material of the multibeam diffraction gratings 440 may include the material of the plate light guide 420. As illustrated in FIG. 5B, for example, the multibeam diffraction grating 440 includes ridges that protrude from the surface of the plate light guide 420, wherein the ridges may be substantially parallel to one another. In FIG. 5A (and FIG. 4A), the multibeam diffraction grating 440 includes grooves that penetrate the surface of the plate light guide 420, wherein the grooves may be substantially parallel to one another. In other examples (not illustrated), the multibeam diffraction grating 440 may comprise a film or layer applied or affixed to the light guide surface. The plurality of light beams 406 in different principal angular directions provided by the multibeam diffraction gratings 440 is configured to form a light field in a viewing direction of an electronic display. In particular, the multibeam diffraction grating-based display 400 employing collimation is configured to provide information, e.g., 3D information, corresponding to pixels of an electronic display.

Figure 6A:
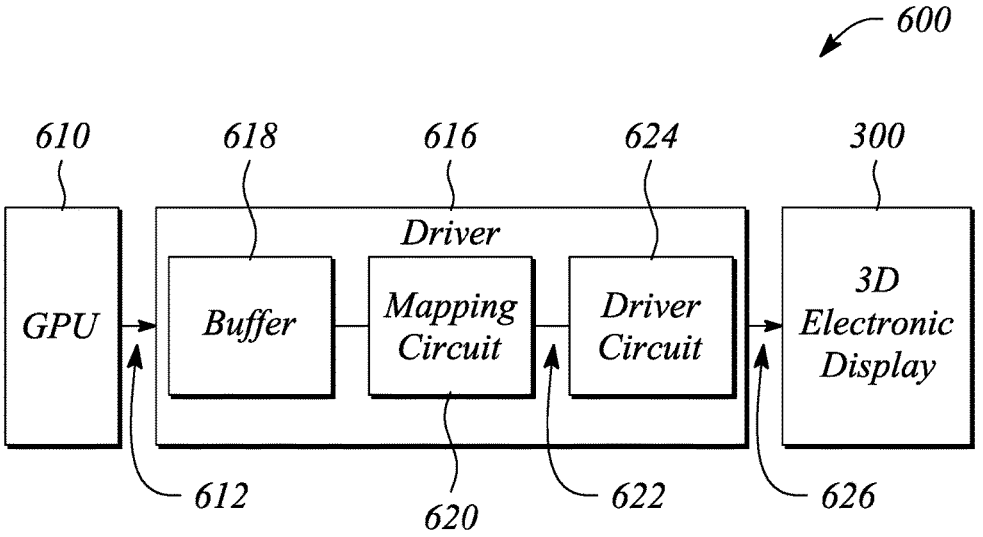
FIG. 6A illustrates a block diagram of an electronic device that includes a 3D electronic display in an example, according to an embodiment of the principles described herein.

According to some embodiments, the image-processing technique may be implemented using an electronic device. FIG. 6A illustrates a block diagram of an electronic device 600 that includes 3D electronic display 300 in an example, according to an embodiment of the principles described herein. As illustrated, the electronic device 600 comprises a graphics processing unit (GPU) 610. The graphics processing unit 610 is configured to generate a tiled image 612 with separate 3D views (such as the tiled image 200 with the 3D views 210 described previously) based on a 3D image. For example, the graphics processing unit 610 may determine or calculate the 3D views in the tiled image 612 by projecting the 3D image along principal angular directions 370, applying a rotation operator to the 3D image or both.

After receiving the tiled image 612, a driver 616 may store the tiled image 612 in a buffer 618. Note that the buffer 618 may be able to store the entire tiled image 612 with the 3D views, such as a full frame of 3D video. Then, a mapping circuit 620 (such as control or routing logic, and more generally a mapping or a transformation block) transforms the tiled image 612 into a composite image 622. Next, a driver circuit 624 drives or applies pixel drive signals 626 to the 3D electronic display 300 based on the composite image 622.

Note that the pixel drive signals 626 may be six (6) or eight (8) bit digital values that result in discrete or stepwise analog signals applied to the cells or pixels 360 in the 3D electronic display 300. However, more generally, the pixel drive signals 626 may be analog signals or digital values. The discrete analog signals may include voltages that oriented the molecules in a twisted nematic liquid crystal (which is used as a non-limiting example of the light values 350) so that the birefringence of the twisted nematic liquid crystal produces a desired rotation or phase change of the light beams 306 as they transit the pixels 360. The varying phase change may result in different intensities of light being passed by crossed polarizers in the pixels 360 (and, thus, different intensities of the modulated light beams 306'). In this way, a desired brightness and contrast can be produced across the 3D electronic display 300. In addition, a location in color space can be obtained by applying different voltages to subsets of the pixels 360 associated with different colors (in embodiments where color filters are used) or by applying different voltages to the pixels 360 at different times (in embodiments where the color of the light beams 306 varies sequentially as a function of time between different colors, i.e., light beams are color light beams in a field-sequential-color system). In particular, the human visual system may integrate the different intensities of different colors for the different pixels 360 to perceive a location in color space.

In some embodiments, the tiled image 612 has or is compatible with an image file having one of multiple different formats.

Figure 6B:
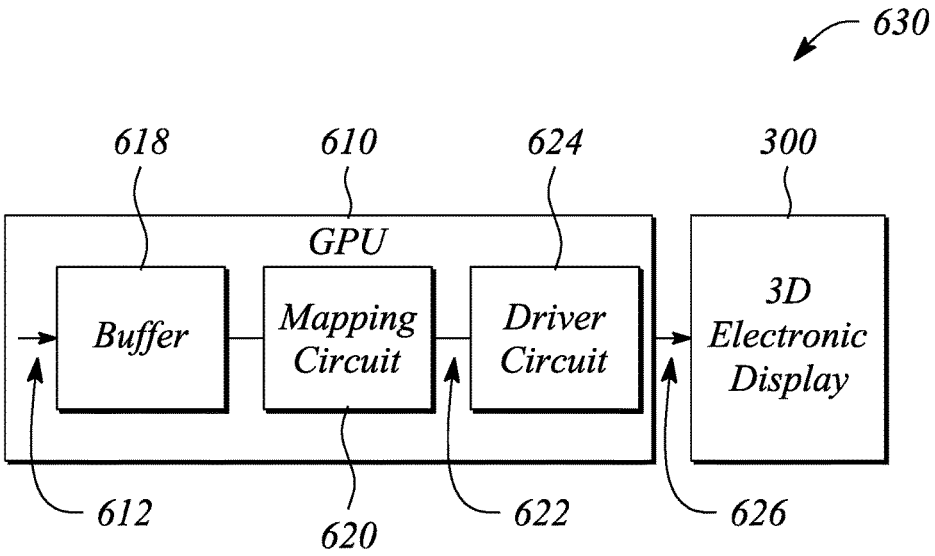
FIG. 6B illustrates a block diagram of an electronic device that includes a 3D electronic display in an example, according to another embodiment of the principles described herein.

Instead of a separate driver 616, in some embodiments some or all of the functionality in the driver 616 is included in the graphics processing unit. This is shown in FIG. 6B, which illustrates a block diagram of an electronic device 630 that includes the 3D electronic display 300 in an example, according to another embodiment of the principles described herein. In particular, in FIG. 6B, a graphics processing unit 632 includes components of the driver 616.

While FIGS. 6A and 6B illustrate the image-processing technique in electronic devices that include the 3D electronic display 300, in some embodiments the image-processing technique is implemented in one or more components in one of the electronic devices 600 and 630, such as one or more components in the 3D electronic display 300, which may be provide separately from or in conjunction with a remainder of the 3D electronic display 300 or one of the electronic devices 600 and 630.

Embodiments consistent with the principles described herein may be implemented using a variety of devices and circuits including, but not limited to, one of integrated circuits (ICs), very large scale integrated (VLSI) circuits, application specific integrated circuits (ASIC), field programmable gate arrays (FPGAs), digital signal processors (DSPs), and the like, firmware, software (such as a program module or a set of instructions), and a combination of two or more of the above. For example, elements or 'blocks' of an embodiment consistent with the principles described herein may all be implemented as circuit elements within an ASIC or a VLSI circuit. Implementations that employ an ASIC or a VLSI circuit are examples of hardware-based circuit implementation, for example. In another example, an embodiment may be implemented as software using a computer programming language (e.g., C/C++) that is executed in an operating environment or software-based modeling environment (e.g., Matlab®, MathWorks, Inc., Natick, Mass.) that is executed by a computer (e.g., stored in memory and executed by a processor or a graphics processor of a computer). Note that the one or more computer programs or software may constitute a computer-program mechanism, and the programming language may be compiled or interpreted, e.g., configurable or configured (which may be used interchangeably in this discussion), to be executed by a processor or a graphics processor of a computer. In yet another example, some of the blocks, modules or elements may be implemented using actual or physical circuitry (e.g., as an IC or an ASIC), while other blocks may be implemented in software or firmware. In particular, according to the definitions above, some embodiments described herein may be implemented using a substantially hardware-based circuit approach or device (e.g., ICs, VLSI, ASIC, FPGA, DSP, firmware, etc.), while other embodiments may also be implemented as software or firmware using a computer processor or a graphics processor to execute the software, or as a combination of software or firmware and hardware-based circuitry, for example.

The electronic device can be (or can be included in): a desktop computer, a laptop computer, a subnotebook/netbook, a server, a tablet computer, a smartphone, a cellular telephone, a smartwatch, a consumer-electronic device, a portable computing device, an integrated circuit, a portion of a 3D electronic display (such as a portion of the 3D electronic display 600) or another electronic device. This electronic device may include some or all of the functionality of the electronic device 900 or 930.

An integrated circuit may implement some or all of the functionality of the electronic device. The integrated circuit may include hardware mechanisms, software mechanisms or both that are used for determining the composite image, generating pixel drive signals or both. In some embodiments, an output of a process for designing the integrated circuit, or a portion of the integrated circuit, which includes one or more of the circuits described herein may be a computer-readable medium such as, for example, a magnetic tape or an optical or magnetic disk. The computer-readable medium may be encoded with data structures or other information describing circuitry that may be physically instantiated as the integrated circuit or the portion of the integrated circuit. Although various formats may be used for such encoding, these data structures are commonly written in: Caltech Intermediate Format (CIF), Calma GDS II Stream Format (GDSII) or Electronic Design Interchange Format (EDIF). Those of skill in the art of integrated circuit design can develop such data structures from schematic diagrams of the type detailed above and the corresponding descriptions and encode the data structures on the computer-readable medium. Those of skill in the art of integrated circuit fabrication can use such encoded data to fabricate integrated circuits that include one or more of the circuits described herein.

Figure 7:
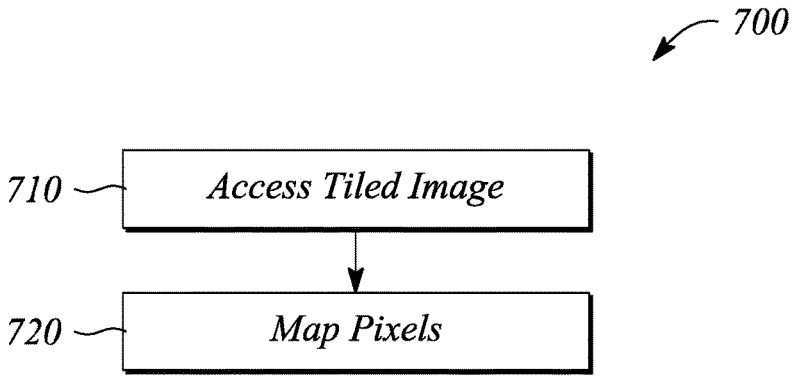
FIG. 7 illustrates a flow chart of a method of transforming a tiled image into a composite image in an example, according to an embodiment consistent with the principles described herein.

In accordance with other embodiments of the principles described herein, a method of transforming a tiled image into a composite image is provided is provided. FIG. 7 illustrates a flow chart of a method 700 of transforming a tiled image into a composite image in an example, according to an embodiment consistent with the principles described herein. This method may be performed by an electronic device, such as one of the preceding embodiments of the electronic device or a component in one of the preceding embodiments of the electronic device. The method 1000 of transforming a tiled image into a composite image comprises accessing a tiled image (operation 710) stored in a buffer in a display driver, where the tiled image includes different 3D views of a 3D image. The method 1000 of transforming a tiled image into a composite image further comprises mapping pixels (operation 712) from the different 3D views into pixels at corresponding locations in a composite image, where the composite image spatially interleaves the pixels from the different 3D views so that pixels from each of the different 3D views are distributed across the composite image.

While some of the preceding embodiments illustrated the buffer in the display driver, in other embodiments the buffer may be located elsewhere in the electronic device, i.e., the buffer may or may not be included in the display driver.

Thus, there have been described examples of an image-processing technique that facilitates display of 3D views of a 3D image using a 3D electronic display, by transforming or mapping pixels in a tiled image into a composite image. In particular, pixels in the tiled image associated with the 3D views are mapped into pixels at corresponding locations in the composite image, where the composite image spatially interleaves the pixels from the different 3D views so that pixels from each of the different 3D views are distributed across the composite image. It should be understood that the above-described examples are merely illustrative of some of the many specific examples that represent the principles described herein. Clearly, those skilled in the art can readily devise numerous other arrangements without departing from the scope as defined by the following claims.

What is claimed is:

1. A three-dimensional (3D) display driver of a backlight, the 3D display driver comprising:

a single buffer configured to store a tiled image including a plurality of tiles having a contiguous arrangement within the single buffer, each tile of the plurality of tiles representing a different 3D view of a 3D image, wherein the different 3D views have associated angular ranges and principal angular directions; and a mapping circuit electrically coupled to the single buffer and configured to access the stored tiled image and to map pixels from the different 3D views into pixels at corresponding locations in a composite image, wherein the composite image is configured to spatially interleave the pixels from the different 3D views so that pixels from each of the different 3D views are distributed across the composite image, wherein the backlight comprises the 3D display driver and further comprises:

a plate light guide configured to guide collimated light at a non-zero propagation angle; and a multibeam diffraction grating at a surface of the plate light guide, the multibeam diffraction grating comprising a plurality of contiguous diffractive features and being configured to diffractively couple out a portion of the collimated light from the plate light guide as a plurality of light beams emitted from a surface of the plate light guide, wherein light beams of the light beam plurality have different principal angular directions from one another, the light beams of the light beam plurality being configured to collectively form a light field consistent with directions of the different 3D views and the light beams of the light beam plurality representing different ones of the pixels of the different 3D views.

2. The 3D display driver of claim 1, further comprising a driver circuit electrically coupled to the mapping circuit and configured to drive pixels in a 3D electronic display based on the composite image.

3. The 3D display driver of claim 1, wherein sequential pixels in each of the 3D views are mapped to pixels in different regions in the composite image.

4. The 3D display driver of claim 1, wherein the backlight further comprises a light source optically coupled to the plate light guide and configured to provide the collimated light to the plate light guide at the non-zero propagation angle.

5. The 3D display driver of claim 4, wherein the light source comprises a plurality of different optical sources configured to provide different colors of light at different, color-specific, non-zero propagation angles corresponding to each of the different colors of the light.

6. A 3D electronic display comprising the backlight of claim 1, the 3D electronic display further comprising a light valve to modulate the light beam of the light beam plurality, the light valve being adjacent to the multibeam diffraction grating.

7. A three-dimensional (3D) electronic display comprising:

a mapping circuit configured to map pixels from different 3D views of a 3D image in a tiled image stored in a single buffer into pixels at corresponding locations in a composite image, each of the different 3D views being stored in a different tile of a plurality of contiguous tiles of the tiled image stored in the single buffer, wherein the composite image is configured to spatially interleave the pixels from the different 3D views so that pixels from each of the different 3D views are distributed across the composite image;

a plate light guide configured to guide collimated light as a guided light beam at a non-zero propagation angle; and an array of multibeam diffraction gratings at a surface of the plate light guide, each multibeam diffraction grating of the multibeam diffraction grating array comprising contiguous diffractive features and being configured to diffractively couple out a portion of the guided light beam as a plurality of coupled-out light beams having different principal angular directions corresponding to view directions of the different 3D views, wherein the plurality of coupled-out light beams diffractively coupled-out by each multibeam diffraction grating forms a light field consistent with the view directions of the different 3D views of the 3D image.

8. The 3D electronic display of claim 7, wherein a multibeam diffraction grating of the array of multibeam diffraction gratings comprises a chirped diffraction grating having curved contiguous diffractive features.

9. The 3D electronic display of claim 7, wherein a multibeam diffraction grating of the array of multibeam diffraction gratings comprises a linear chirped diffraction grating.

10. The 3D electronic display of claim 7, further comprising a light valve array configured to selectively modulate coupled-out light beams of the coupled-out light beam plurality as 3D pixels corresponding to the different 3D views of the 3D electronic display.

11. The 3D electronic display of claim 7, further comprising a display driver electrically coupled to the mapping circuit and being configured to drive the pixels in the 3D electronic display based on the composite image.

12. The 3D electronic display of claim 7, further comprising a graphics processor electrically coupled to the mapping circuit and being configured to generate the tiled image based on the 3D image.

13. The 3D electronic display of claim 7, wherein sequential pixels in each of the different 3D views are mapped to pixels in different regions in the composite image.

14. The 3D electronic display of claim 13, wherein the different regions correspond to different multibeam diffraction gratings in the array of multibeam diffraction gratings.

15. A method of transforming a tiled image into a composite image, the method comprises:

accessing a tiled image stored in a single buffer in a display driver, the tiled image including a plurality of tiles having a contiguous arrangement, wherein each tile of the tiled image includes a different one of a plurality of different 3D views of a 3D image;

mapping pixels from different 3D views of the plurality of different 3D views into pixels at corresponding locations in a composite image, wherein the composite image spatially interleaves the pixels from the different 3D views so that pixels from each of the different 3D views are distributed across the composite image; and diffractively coupling out a portion of collimated guided light from within a plate light guide as a plurality of the light beams having different principal angular directions, the light beams being emitted from a surface of a 3D electronic display using an array of multibeam diffraction gratings, each multibeam diffraction grating comprising contiguous diffractive features and diffractively coupling out a separate plurality of the light beams, wherein the different principal angular directions of the light beams within each light beam plurality correspond to view directions of the plurality of different 3D views, the light beams within each light beam plurality collectively forming a light field consistent with the view directions.

16. The method of claim 15, further comprising driving light valves associated with pixels in the 3D electronic display based on the composite image so that the light valves modulate light beams having different principal angular directions, wherein driving light valves comprises using a driver circuit.

17. The method of claim 16, wherein the light beams represent different ones of the pixels of the plurality of different 3D views of the 3D image being displayed by the 3D electronic display as the composite image.

18. The method of claim 15, wherein different regions in the composite image correspond to different multibeam diffraction gratings in the array of multibeam diffraction gratings.

19. The method of claim 15, wherein sequential pixels in each different 3D view of the plurality of different 3D views are mapped to pixels in different regions in the composite image.

* * * * *